US006719610B2

(12) United States Patent
Chou et al.

(10) Patent No.: US 6,719,610 B2
(45) Date of Patent: Apr. 13, 2004

(54) METHOD AND DEVICE FOR GRINDING PARTICULATES

(75) Inventors: Ta-Hsin Chou, Kaohusing (TW); Wen-Yeu Lee, Tainan (TW); Lei-Yi Chen, Hsinchu Hsien (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 0 days.

(21) Appl. No.: 10/270,575

(22) Filed: Oct. 16, 2002

(65) Prior Publication Data

US 2004/0038628 A1 Feb. 26, 2004

(30) Foreign Application Priority Data

Aug. 26, 2002 (TW) ..... 91119296 A

(51) Int. Cl.[7] ..... B24C 9/00

(52) U.S. Cl. ..... 451/28; 241/171; 241/172; 241/80; 451/87

(58) Field of Search ..... 241/171–172, 241/80, 21; 451/32, 35, 28, 38, 104, 93, 113, 87

(56) References Cited

U.S. PATENT DOCUMENTS

| | | | | | |
|---|---|---|---|---|---|
| 3,987,967 | A | * | 10/1976 | Kuznetsov et al. | 239/124 |
| 4,505,072 | A | * | 3/1985 | Kobayashi et al. | 451/329 |
| 4,601,431 | A | * | 7/1986 | Watanabe et al. | 241/172 |
| 5,346,145 | A | | 9/1994 | Kamiwano et al. | |
| 5,566,896 | A | * | 10/1996 | Stehr et al. | 241/171 |
| 5,597,126 | A | * | 1/1997 | Frommherz et al. | 241/172 |
| 5,620,147 | A | | 4/1997 | Newton | |
| 5,630,557 | A | * | 5/1997 | Barthelmess | 312/265.6 |
| 5,882,246 | A | * | 3/1999 | Inkyo et al. | 451/87 |

* cited by examiner

*Primary Examiner*—George Nguyen
(74) *Attorney, Agent, or Firm*—Rabin & Berdo, P.C.

(57) ABSTRACT

A particulate grinding method and device applies different force fields to drive the grinding medium and the particulates move in different routes but collide only at a grinding area so that they are separated naturally without conventional screening mechanisms, such as a screen or a gap, and prevented from the limitation of mechanical size of the components. Moreover, the invention is applicable to finer particulates. The circulation of particulates is not limited by any small gap of screening mechanisms, so the particulates ill not block the separator.

22 Claims, 1 Drawing Sheet

METHOD AND DEVICE FOR GRINDING PARTICULATES

BACKGROUND OF THE INVENTION

1. Field of the Invention

The invention generally relates to a method and device of grinding, and particularly relates to a method and device for grinding fine particulates.

2. Related Art

Nano-scale science and technology is currently the newest technology being developed by advanced countries. The nano-scale science and technology mainly includes three aspects of nano-elements, nano materials and nano inspection and characterization. Nano-elements are objects whose dimensions are measured in the nanometer scale. Nano materials have many special properties that are applicable in many kinds of industry.

In view of the development and application of nano-scale dye particulates, the nano-dye particulates produce less diffraction and make the color extremely pure and brilliant. The nano-dye particulates are also characterized in water-resistance, lightfastness and climate-resistance so that they will expand great markets in printing, dyeing and inkjet-printing, and facilitate the developments of high-value and high-performance delicate printing, fabric dyeing and high-level inkjet-printing.

Common dye particulates are made from a wet-dispersing process. The raw material of dye is mechanically driven and collided with hard grinding medium, so that the dye particles are dispersed into micro-scale particulates. The dye material and the grinding medium are imported into a grinding mill and moisturized with a grinding liquid. Blades or other stirring mechanisms are used to stir the dye material and the grinding medium at a high speed so as to disperse and grind the dye material. The dye particulates ground to a certain extent are then separated from the grinding medium by a screening mechanism and carried by the grinding liquid to a powder collector. The grinding blade or stirring mechanism is easy to be worn by the high-speed collisions of the dye material and the grinding medium. As a result, the grinding blade or stirring mechanism has to be replaced occasionally. In order to obtain a better result, a mechanical grinding system has also to be precisely controlled with the grinding parameters, which makes the design, installation and control of the grinding machine very delicate and complicated.

There is also a problem of particulate separation in the conventional grinding method. A common grinding machine utilizes mechanical devices such as a gap or a screen to separate the particulates from the grinding medium. For example, in U.S. Pat. No. 5,620,147, a micro-scale filter screen is used for separation of the particulates from the grinding medium. However, since the grinding medium is also small and easy to block and wear the screen, the separation is not quite satisfied. In U.S. Pat. No. 5,346,145, a gap-type separator having a stator and a rotor is used. However, it still encounters the problem of wear of the components and block-up of the grinding medium. Above all, the mechanical screening devices are limited with their dimensions that cannot achieve separation of finer particulates.

The nano-scale dye particulates, for example, are difficult to be separated from the grinding medium since they are all tiny particulates that cannot be screened with conventional mechanical screening devices. The difficulty also retards the development of nano-scale particulates.

SUMMARY OF THE INVENTION

In order to solve the aforesaid problems, the object of the invention is to provide a particulate grinding method and device in which two different kinds of force fields are applied to drive the particulates and the grinding medium respectively. The particulates and the grinding medium are driven and moved in different flow directions so as to collide with each other, and the particulates are dispersed. The grinding medium is controlled by a force field to flow in a grinding area, while the particulates are controlled by another force field to pass through the grinding area and circulate in another flow route. Since the particulates and the grinding medium are driven by different force fields, they are naturally separated after the collision and dispersion.

A grinding method according to the invention includes the following steps. First, providing a first force field for driving grinding medium flow in a specific area that is defined as a grinding area. Then, providing and controlling a second force field for driving the particulates pass through the grinding area, collide with the grinding medium and circulate in a flow route so as to disperse the particulates efficiently and continuously. And finally, guiding the finished particulates flow out and be collected. The kinds of the first and second force fields are determined by characteristics of the grinding medium and the particulates. For example, when the grinding medium is magnetic, the first force field can be a magnetic field. The second force field has to be chosen from a different kind so as to prevent the particulates from mixing with the grinding medium. For example, when the first force field is a magnetic field, the second force field is chosen from hydrodynamic force, electromagnetic field, gravitational field or others.

A particulate grinding device according to the invention includes: a chamber, having a grinding area in which a grinding medium is driven and moved by a first force field; a first driving mechanism for generating the first force field; a particulate flow pipe, connected to an inlet and an outlet of the chamber for circulating the particulates, having a filling port and a output port; and a second driving mechanism for generating a second force field. Particulate material is filled into the flow pipe from the filling port, driven by the second force field to flow into the chamber from the inlet and to collide with the grinding medium at the grinding area. Then, the particulates are driven to leave the chamber through the outlet, flow into the flow pipe and further circulate for the next collision and dispersion. The finished fine particulates are controlled to flow out from the output port.

BRIEF DESCRIPTION OF THE DRAWINGS

The invention will become more fully understood from the detailed description given hereinbelow. However, this description is for purposes of illustration only, and thus is not limitative of the invention, wherein.

DETAILED DESCRIPTION OF THE INVENTION

Figure 1:
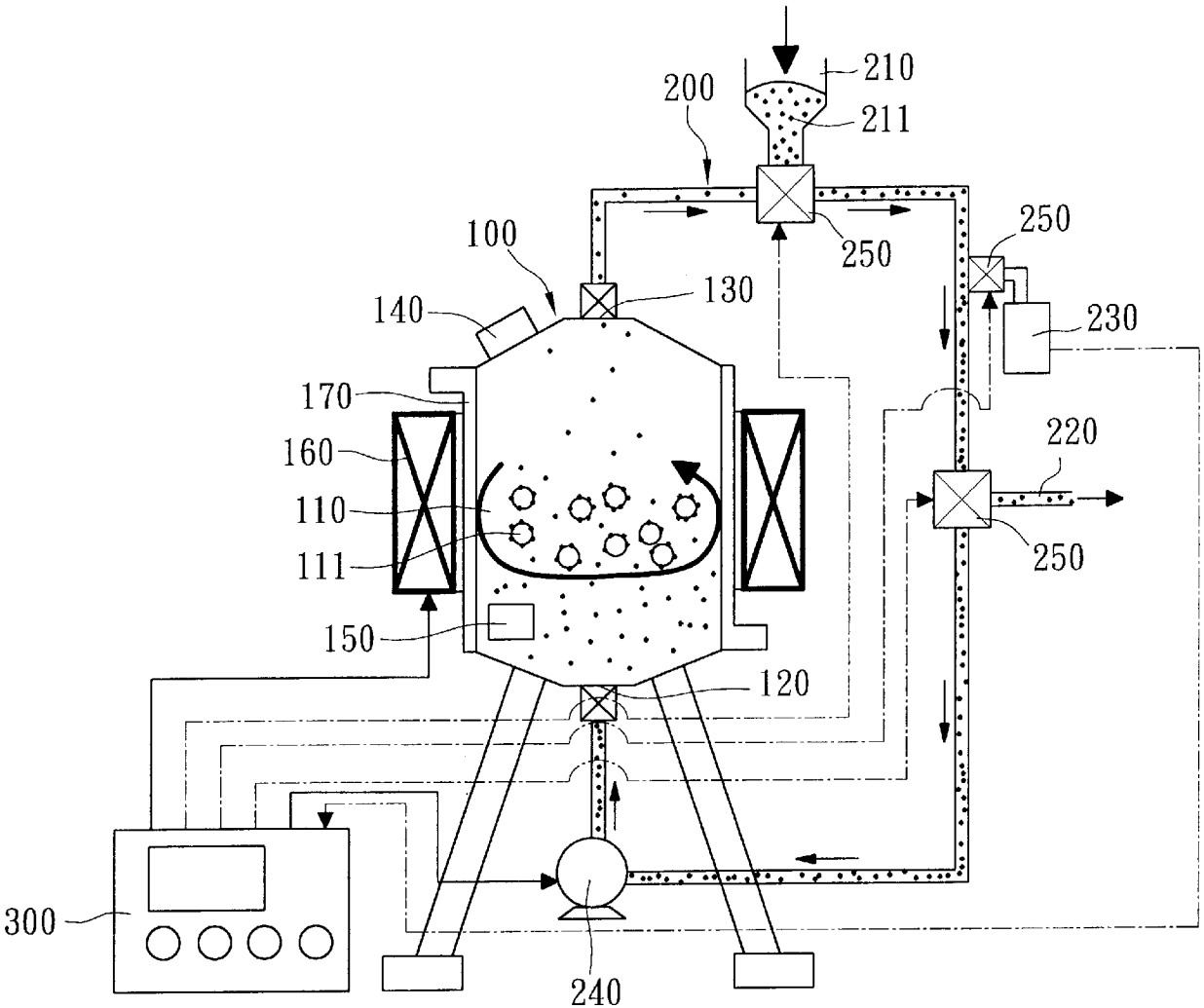
FIG. 1 is a descriptive view of a grinding device of the invention.

Referring to FIG. 1, a descriptive view of an embodiment of the invention is shown. The grinding device mainly includes a chamber 100 having a grinding area 110, and a particulate flow pipe 200 for circulating the particulates. The grinding area 110 is formed by a magnetic grinding medium 111 driven and moved in a specific region by a magnetic field. An electromagnetic coil 160 generates the magnetic field and activates the grinding medium to move in a certain direction within the grinding area 110. As shown in FIG. 1, the chamber 100 includes a particulate inlet 120, particulate outlet 130 and a grinding medium inlet 140. The chamber 100 is surrounded with the electromagnetic coil 160 and a water jacket 170 for cooling the heat of the chamber 100 caused by collision of the particulates and the grinding medium 111. The chamber 100 may also include an observation window 150 for a user to observe the interior condition of the chamber 100.

The particulate flow pipe 200 is connected to the particulate inlet 120 and the particulate outlet 130 of the chamber 100, and a pump 240 for circulating the particulates. The flow pipe 200 also includes a filling port 210 and an output port 220. Particulate material 211 is filled into the flow pipe 200 from the filling port 210, driven by the pump 240 to flow into the chamber 100 via the inlet 120 and to collide with the grinding medium 111 in the grinding area 110. Then, the particulates are driven to leave the chamber 100 through the outlet 130, flow into the flow pipe 200 and further circulate for the next collision and dispersal. A sampling port 230 is also connected to the flow pipe 200 for taking and checking samples of the particulates. After the particulates are well ground to the desired size, the finished particulates are controlled to flow out from the output port 220. There are three triple valves 250 for controlling the filling port 210, the output port 220 and the sampling port 230 respectively. There is also a controller 300 electrically connected to the electromagnetic coil 160, the pump 240 and the three valves 250 for controlling the magnetic force to the grinding medium 111, the force of the pump 240 and the filling, output and sampling of the particulates.

An embodiment of the particulate grinding method of the invention will be further described in accompany with the illustration. First, the non-magnetic particulate material 211 and a dispersal liquid are filled into the filling port 210. The valve 250 of the filling port 210 is opened by the controller 300 and the pump 240 is activated to bring the particulates 211 into the chamber 100 through the flow pipe 200. With the observation window 150, the filling amount of particulates 211 in the grinding area 110 are observed. The electromagnetic coil 160 is activated when the particulates 211 have being adequately filled. Then, the magnetic grinding medium 111 is filled into the chamber 100 via the grinding medium inlet 140. The magnetic force of the electromagnetic coil 160 is controlled to hold the grinding medium 111 in the central portion of the chamber 100 and form a grinding area 110. The grinding medium inlet 140 is closed when the grinding medium is adequately filled. The force of the pump 240 and opening the flow pipe 200 are controlled to move the particulates 211 and the dispersal liquid to pass through the grinding area 110 and circulate through the pipe 200 and the chamber 100. As the particulates 211 pass through the grinding area 110 by the hydrodynamic force of the pump 240, and the grinding medium 111 is held in the grinding area 110 by the magnetic force of the electromagnetic coil 160, they collide with each other in the grinding area 110. As a result, the particulates 211 are dispersed and become finer. Since the particulates 211 and the grinding medium 111 are activated by different kinds of force fields and flow in different routes, they are not mixed up with each other. After the particulates 211 are dispersed and ground for a certain time, the particulates 211 are sampled through the sampling port 230 by opening the triple valve 250 by the controller 300. The analysis result of the particulate sample is a feedback to the controller 300 so that when the particulates 211 are finished being ground, they flow out from the output port 220 by the control of the controller 300 to the triple valve 250 of the output port 220. Then, a next filling and grinding continues. Anytime as the grinding medium 111 is to be replaced, the particulate inlet 120 and the particulate outlet 130 are closed, the electromagnetic coil 160 is turned off, and the grinding medium 111 can be taken out.

In conclusion, the invention applies different force fields to drive the grinding medium and the particulates so that they are separated naturally without the need of conventional screening mechanisms, such as a screen or a gap, and prevented from the limitation of mechanical size. Moreover, the invention is applicable to finer particulates. The circulation of particulates is not limited by any small gap of screening mechanisms, so the particulates will not block the separator.

Furthermore, the invention does not use any stirring blade so it without the problem of wear of the blades in conventional grinding devices. The chamber of the invention is a simple construction without delicate machining so that it is also easy to be made and cleaned.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A particulate grinding method, comprising:

supplying particulates and a dispersal liquid into a chamber;

supplying a grinding medium into the chamber;

providing a first force that acts primarily on the grinding medium as compared to its action on the particulates, to cause the grinding medium to flow in a grinding area in the chamber;

providing and controlling a second force that acts primarily on the particulates as compared to its action on the grinding medium, to cause the particulates to pass through the grinding area, collide with the grinding medium, and circulate in a flow route so as to disperse the particulates; and outputting the particulates after grinding is finished.

2. A particulate grinding method according to claim 1, wherein the first force is determined according to characteristics of the grinding medium.

3. A particulate grinding method according to claim 1, wherein the second force is determined according to characteristics of the particulates.

4. A particulate grinding method according to claim 1, wherein the first force and the second force are different kinds of forces in order to prevent mixing of the particulates and the grinding medium.

5. A particulate grinding method according to claim 1, wherein the particulates and the dispersal liquid are supplied to the chamber by a pump.

6. A particulate grinding method according to claim 1, wherein the first force is generated by an electromagnetic coil.

7. A particulate grinding method according to claim 1, wherein the second force is generated by a pump that drives the particulates and the dispersal liquid to pass through the chamber and circulate in the flow route.

8. A particulate grinding method according to claim 1, wherein finished particulates are first sampled and checked through a sampling port.

9. A particulate grinding method according to claim 1, wherein the first force and the second force are chosen from any two of a magnetic force, hydrodynamic force, electrostatic force and gravitational force.

10. A particulate grinding method according to claim 1, wherein said supplying particulates and a dispersal liquid, and said outputting the particulates are controlled by a controller.

11. A particulate grinding device, comprising:

a generally closed chamber, having a particulate inlet and a particulate outlet, and a grinding area defined therein;

a first driving mechanism for generating a first force that acts primarily on a grinding medium as compared to its action on particulates, to move the grinding medium in the grinding area;

a second driving mechanism for generating a second force that acts primarily on the particulates as compared to its action on the grinding medium, to move the particulates from the particulate input, across the grinding area and out the particulate outlet; and a flow pipe, connected to said particulate inlet and said particulate outlet and forming a particulate circulation route having a filling port and an output port, said particulates being driven by the second force to flow into said chamber from said inlet and to collide with said grinding medium at said grinding area, said particulates being driven to leave said chamber through said outlet, flow into said flow pipe and circulate in said circulation route for further collision and dispersal, and finally flow out from said output port when being finished with grinding.

12. A particulate grinding device according to claim 11, wherein said first driving mechanism is determined according to characteristics of said grinding medium.

13. A particulate grinding device according to claim 11, wherein said first driving mechanism is an magnetic device, and said grinding medium is a magnetic material.

14. A particulate grinding device according to claim 11, wherein said first driving mechanism is an electromagnetic coil.

15. A particulate grinding device according to claim 11, wherein said second driving mechanism is determined according to characteristics of said particulates.

16. A particulate grinding device according to claim 11, wherein said second driving mechanism is a pump.

17. A particulate grinding device according to claim 11, wherein said first and said second driving mechanisms are chosen from any two of a magnetic device, hydrodynamic device, electrostatic device and gravitational device.

18. A particulate grinding device according to claim 11, further comprising a sampling port for sampling and checking a grinding condition of said particulates.

19. A particulate grinding device according to claim 11, further comprising a filling port for filling said grinding medium.

20. A particulate grinding device according to claim 11, further comprising a triple valves for controlling the flow of said particulates.

21. A particulate grinding method according to claim 1, wherein the first force is provided using a first driving mechanism, and the second force is provided using a second driving mechanism, the first and second driving mechanisms being disposed completely outside of the chamber.

22. A particulate grinding device according to claim 11, wherein said first and second driving mechanisms are disposed completely outside of said chamber.

* * * * *